US011594810B1

(12) United States Patent
Prasannakumar et al.

(10) Patent No.: US 11,594,810 B1
(45) Date of Patent: Feb. 28, 2023

(54) ANTENNA ISOLATION USING PARASITIC ELEMENT IN WIRELESS DEVICES

(71) Applicant: Meta Platforms Technologies, LLC, Menlo Park, CA (US)

(72) Inventors: Prathap Valale Prasannakumar, Mountain View, CA (US); Umar Azad, Santa Clara, CA (US)

(73) Assignee: Meta Platforms Technologies, LLC, Menlo Park, CA (US)

( * ) Notice: Subject to any disclaimer, the term of this patent is extended or adjusted under 35 U.S.C. 154(b) by 0 days.

(21) Appl. No.: 17/404,474

(22) Filed: Aug. 17, 2021

(51) Int. Cl.
*H01Q 1/27* (2006.01)
*H01Q 1/38* (2006.01)
*H01Q 1/48* (2006.01)

(52) U.S. Cl.
CPC ..... *H01Q 1/273* (2013.01); *H01Q 1/38* (2013.01); *H01Q 1/48* (2013.01)

(58) Field of Classification Search
CPC ..... H01Q 1/27; H01Q 1/38; H01Q 1/48
See application file for complete search history.

(56) References Cited

U.S. PATENT DOCUMENTS 10,784,578 B2 9/2020 Chou
2015/0207219 A1* 7/2015 Oh ..... H01Q 1/50 343/702
2016/0197404 A1* 7/2016 Hashimoto ..... H01Q 1/48 343/848
2019/0214721 A1 7/2019 Hu et al.
2020/0021029 A1 1/2020 Chou et al.

FOREIGN PATENT DOCUMENTS

WO 2020173298 A1 9/2020

OTHER PUBLICATIONS

International Search Report and Written Opinion for International Application No. PCT/US2022/040463 dated Nov. 7, 2022, 11 pages.

* cited by examiner

*Primary Examiner* — Andrea Lindgren Baltzell
(74) *Attorney, Agent, or Firm* — Foley & Lardner LLP

(57) ABSTRACT

Disclosed herein includes a wireless device including a first antenna configured to perform wireless communication, a second antenna configured to perform wireless communication, and a parasitic antenna. The first antenna may have a feed connected to a first impedance tuner that is connected to a first ground planes. The second antenna may have a feed connected to a second impedance tuner. The parasitic antenna may be disposed between the first and second antennas, with a feed connected to a third impedance tuner that is connected to a second ground plane. The first, second and third impedance tuners may be adjusted to configure the first, second and parasitic antennas to achieve a same resonant frequency.

20 Claims, 11 Drawing Sheets

400

ANTENNA ISOLATION USING PARASITIC ELEMENT IN WIRELESS DEVICES

FIELD OF DISCLOSURE

The present disclosure is generally related to an apparatus and method for improving isolation between antennas, including but not limited to use of a parasitic element and/or impedance tuner(s).

BACKGROUND

Artificial reality such as a virtual reality (VR), an augmented reality (AR), or a mixed reality (MR) provides immersive experience to a user. In one example, a user wearing a head wearable display (HWD) can turn the user's head, and an image of a virtual object corresponding to a location of the HWD and a gaze direction of the user can be displayed on the HWD to allow the user to feel as if the user is moving within a space of artificial reality (e.g., a VR space, an AR space, or a MR space).

In one implementation, an image of a virtual object is generated by an artificial reality computing device communicatively coupled to the HWD. In one example, the HWD includes various sensors that detect a location and/or orientation of the HWD, and transmits the detected location and/or orientation of the HWD to the computing device. The computing device can determine a user's view of the space of the artificial reality according to the detected location and/or orientation of the HWD, and generate image data indicating an image of the space of the artificial reality corresponding to the user's view. The computing device can transmit the image data to the HWD, by which the image of the space of the artificial reality corresponding to the user's view can be presented to the user. In one aspect, the process of detecting the location of the HWD and the gaze direction of the user wearing the HWD, and rendering the image to the user should be performed within a frame time (e.g., 11 ms or 16 ms). A latency between a movement of the user wearing the HWD and an image displayed corresponding to the user movement can cause judder, which may result in motion sickness and can degrade the user experience.

SUMMARY

Disclosed herein are related to a wireless device including a first antenna configured to perform wireless communication, a second antenna configured to perform wireless communication, and a parasitic antenna. The first antenna may have a feed connected to a first impedance tuner that is connected to a first ground plane. The second antenna may have a feed connected to a second impedance tuner. The parasitic antenna may be disposed between the first and second antennas, with a feed connected to a third impedance tuner that is connected to a second ground plane. The first, second and third impedance tuners may be adjusted to configure the first, second and parasitic antennas to achieve a same resonant frequency.

In some embodiments, the first antenna and the first ground plane may be implemented on a first printed circuit board (PCB). The parasitic antenna and the second ground plane may be implemented on a second printed circuit board (PCB). The first PCB and the second PCB may be substantially parallel to each other on different planes. A primary surface of the second antenna may be on a plane that is angled relative to the planes of the first PCB and the second PCB.

In some embodiments, the wireless device may include a controller configured to adjust the first, second and third impedance tuners to configure the first, second and parasitic antennas to achieve the same resonant frequency. In some embodiments, the wireless device comprises a handheld controller device.

In some embodiments, the first, second and third impedance tuners may be adjusted at a first time to configure the first, second and parasitic antennas to achieve a first resonant frequency. The first, second and third impedance tuners may be adjusted at a second time to configure the first, second and parasitic antennas to achieve a second resonant frequency.

In some embodiments, the first antenna and the second antenna may be configured to perform wireless communication with a same head wearable device. The first antenna and the second antenna may be configured to perform wireless communication at a same operating frequency with the same head wearable device. The first antenna may be configured to perform wireless communication with the head wearable device using a first wireless communication protocol. The first antenna may be configured to perform wireless communication with the head wearable device using a second wireless communication protocol different from the first wireless communication protocol.

Various embodiments disclosed herein are related to a method including performing, by a first antenna with a feed connected to a first impedance tuner that is connected to a first ground plane, wireless communication. The method may include performing, by a second antenna with a feed connected to a second impedance tuner, wireless communication. A parasitic antenna may be disposed between the first and second antennas. The parasitic antenna may have a feed connected to a third impedance tuner that is connected to a second ground plane. The method may include adjusting, by at least one processor, the first, second and third impedance tuners to configure the first, second and parasitic antennas to achieve a same resonant frequency.

In some embodiments, the first antenna and the first ground plane may be implemented on a first printed circuit board (PCB), and the parasitic antenna and the second ground plane may be implemented on a second printed circuit board (PCB). The first PCB and the second PCB may be substantially parallel to each other on different planes. A primary surface of the second antenna may be on a plane that is angled relative to the planes of the first PCB and the second PCB.

In some embodiments, the method may include receiving, by the at least one processor, data from each of the first, second and parasitic antennas. The method may include adjusting, by the at least one processor according to the received data, the first, second and third impedance tuners to configure the first, second and parasitic antennas to achieve the same resonant frequency. In some embodiments, the first, second and parasitic antennas may be included in a wireless device which comprises a handheld controller device.

In some embodiments, the method may include adjusting, by the at least one processor at a first time, the first, second and third impedance tuners to configure the first, second and parasitic antennas to achieve a first resonant frequency. The method may include adjusting, by the at least one processor at a second time, the first, second and third impedance tuners to configure the first, second and parasitic antennas to achieve a second resonant frequency.

In some embodiments, the method may include performing, by the first antenna, wireless communication with a head wearable device. The method may include performing, by the second antenna, wireless communication with the head wearable device. The method may include performing, by the first antenna, wireless communication with the head wearable device at a defined operating frequency. The method may include performing, by the second antenna, wireless communication with the head wearable device at the defined operating frequency. The method may include performing, by the first antenna, wireless communication with the head wearable device using a first wireless communication protocol. The method may include performing, by the second antenna, wireless communication with the head wearable device using a second wireless communication protocol different from the first wireless communication protocol.

BRIEF DESCRIPTION OF THE DRAWINGS

The accompanying drawings are not intended to be drawn to scale. Like reference numbers and designations in the various drawings indicate like elements. For purposes of clarity, not every component can be labeled in every drawing.

DETAILED DESCRIPTION

Before turning to the figures, which illustrate certain embodiments in detail, it should be understood that the present disclosure is not limited to the details or methodology set forth in the description or illustrated in the figures. It should also be understood that the terminology used herein is for the purpose of description only and should not be regarded as limiting.

Disclosed herein are embodiments related to an apparatus and method for improving isolation between antennas using a parasitic element in wireless devices, including but not limited to, an apparatus and method for improving isolation and mitigating co-existence between antennas in a compact form factor (e.g., in artificial reality devices) using a parasitic antenna element in wireless devices.

In some embodiments, isolation between antennas concurrently operating at the same frequency or band may be improved by at least one of: (1) mounting a parasitic element on a ground plane of a device (e.g. a wireless device) different from one or more ground planes of the antennas of the device, (2) connecting a parasitic element as a parasitic antenna to a switch to terminate the parasitic antenna by one or more of an inductor, a capacitor, a variable resistor, a short circuit, an open-circuit or any combination thereof, (3) connecting the parasitic element to a variable phase shifter before being terminated with a ground plane, or (4) tuning the parasitic element to resonate with at least one of the antennas.

In some embodiments, a wireless device may include a first antenna configured to perform wireless communication, a second antenna configured to perform wireless communication, and a parasitic antenna. The first antenna may have a feed connected to a first impedance tuner. The second antenna may have a feed connected to a second impedance tuner that is connected to a first ground plane. The parasitic antenna may be disposed between the first and second antennas, with a feed connected to a third impedance tuner that is connected to a second ground plane. The first, second and third impedance tuners may be adjusted to configure the first, second and parasitic antennas to achieve a same resonant frequency.

Using the systems and methods described herein, the device can prevent one antenna from being coupled to (or resonating with) another antenna, or at least reduce such coupling, without having to increase the physical separation between the antennas or changing polarizations of the antennas (e.g., to be orthogonal).

Figure 1:
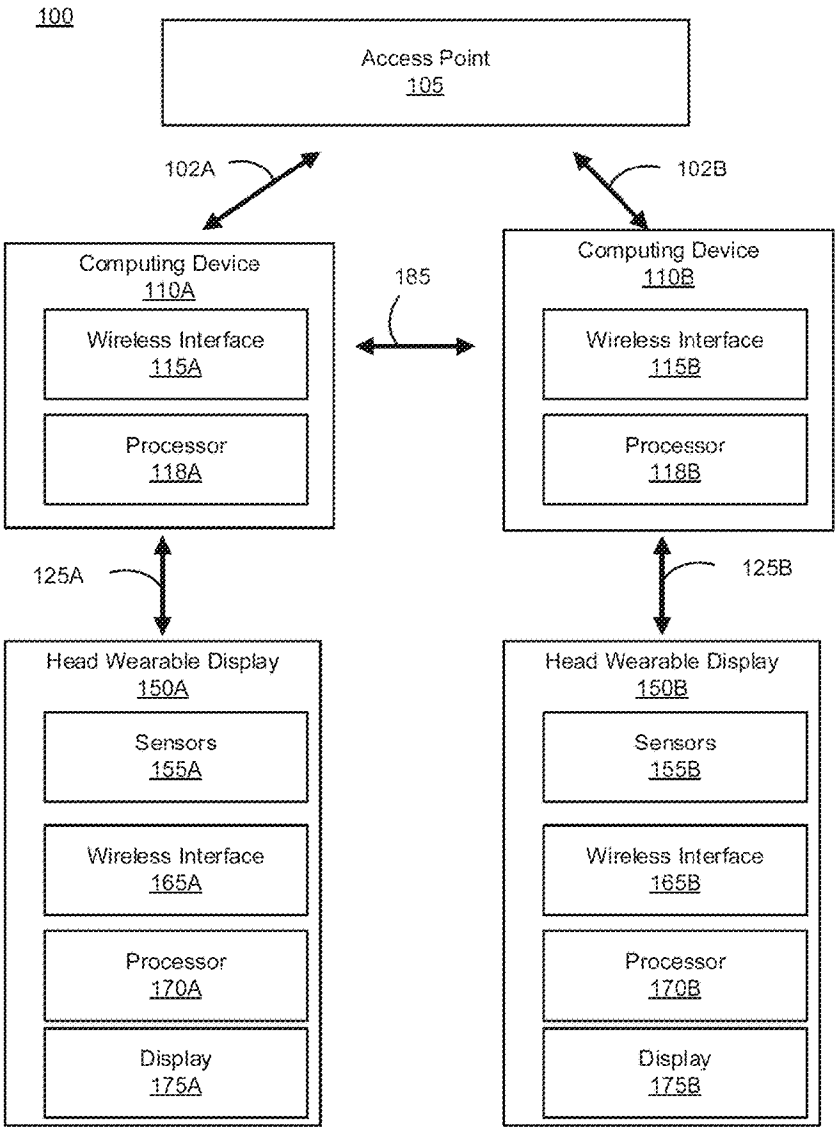
FIG. 1 is a diagram of a system environment including an artificial reality system, according to an example implementation of the present disclosure.

FIG. 1 is a block diagram of an example artificial reality system environment 100. In some embodiments, the artificial reality system environment 100 includes an access point (AP) 105, one or more HWDs 150 (e.g., HWD 150A, 150B), and one or more computing devices 110 (computing devices 110A, 110B; sometimes referred to consoles) providing data for artificial reality to the one or more HWDs 150. The access point 105 may be a router or any network device allowing one or more computing devices 110 and/or one or more HWDs 150 to access a network (e.g., the Internet). The access point 105 may be replaced by any communication device (cell site). A computing device 110 may be a custom device or a mobile device that can retrieve content from the access point 105, and provide image data of artificial reality to a corresponding HWD 150. Each HWD 150 may present the image of the artificial reality to a user according to the image data. In some embodiments, the artificial reality system environment 100 includes more, fewer, or different components than shown in FIG. 1. In some embodiments, the computing devices 110A, 110B communicate with the access point 105 through wireless links 102A, 102B (e.g., interlinks), respectively. In some embodiments, the computing device 110A communicates with the HWD 150A through a wireless link 125A (e.g., intralink), and the computing device 110B communicates with the HWD 150B through a wireless link 125B (e.g., intralink). In some embodiments, functionality of one or more components of the artificial reality system environment 100 can be distributed among the components in a different manner than is described here. For example, some of the functionality of the computing device 110 may be performed by the HWD 150. For example, some of the functionality of the HWD 150 may be performed by the computing device 110.

In some embodiments, the HWD 150 is an electronic component that can be worn by a user and can present or provide an artificial reality experience to the user. The HWD 150 may be referred to as, include, or be part of a head mounted display (HIVID), head mounted device (HMD), head wearable device (HWD), head worn display (HWD) or head worn device (HWD). The HWD 150 may render one or more images, video, audio, or some combination thereof to provide the artificial reality experience to the user. In some embodiments, audio is presented via an external device (e.g., speakers and/or headphones) that receives audio information from the HWD 150, the computing device 110, or both, and presents audio based on the audio information. In some embodiments, the HWD 150 includes sensors 155, a wireless interface 165, a processor 170, and a display 175. These components may operate together to detect a location of the HWD 150 and a gaze direction of the user wearing the HWD 150, and render an image of a view within the artificial reality corresponding to the detected location and/or orientation of the HWD 150. In other embodiments, the HWD 150 includes more, fewer, or different components than shown in FIG. 1.

In some embodiments, the sensors 155 include electronic components or a combination of electronic components and software components that detects a location and an orientation of the HWD 150. Examples of the sensors 155 can include: one or more imaging sensors, one or more accelerometers, one or more gyroscopes, one or more magnetometers, or another suitable type of sensor that detects motion and/or location. For example, one or more accelerometers can measure translational movement (e.g., forward/back, up/down, left/right) and one or more gyroscopes can measure rotational movement (e.g., pitch, yaw, roll). In some embodiments, the sensors 155 detect the translational movement and the rotational movement, and determine an orientation and location of the HWD 150. In one aspect, the sensors 155 can detect the translational movement and the rotational movement with respect to a previous orientation and location of the HWD 150, and determine a new orientation and/or location of the HWD 150 by accumulating or integrating the detected translational movement and/or the rotational movement. Assuming for an example that the HWD 150 is oriented in a direction 25 degrees from a reference direction, in response to detecting that the HWD 150 has rotated 20 degrees, the sensors 155 may determine that the HWD 150 now faces or is oriented in a direction 45 degrees from the reference direction. Assuming for another example that the HWD 150 was located two feet away from a reference point in a first direction, in response to detecting that the HWD 150 has moved three feet in a second direction, the sensors 155 may determine that the HWD 150 is now located at a vector multiplication of the two feet in the first direction and the three feet in the second direction.

In some embodiments, the wireless interface 165 includes an electronic component or a combination of an electronic component and a software component that communicates with the computing device 110. In some embodiments, the wireless interface 165 includes or is embodied as a transceiver for transmitting and receiving data through a wireless medium. The wireless interface 165 may communicate with a wireless interface 115 of a corresponding computing device 110 through a wireless link 125 (e.g., intralink). The wireless interface 165 may also communicate with the access point 105 through a wireless link (e.g., interlink). Examples of the wireless link 125 include a near field communication link, Wi-Fi direct, Bluetooth, or any wireless communication link. Through the wireless link 125, the wireless interface 165 may transmit to the computing device 110 data indicating the determined location and/or orientation of the HWD 150, the determined gaze direction of the user, and/or hand tracking measurement. Moreover, through the wireless link 125, the wireless interface 165 may receive from the computing device 110 image data indicating or corresponding to an image to be rendered.

In some embodiments, the processor 170 includes an electronic component or a combination of an electronic component and a software component that generates one or more images for display, for example, according to a change in view of the space of the artificial reality. In some embodiments, the processor 170 is implemented as one or more graphical processing units (GPUs), one or more central processing unit (CPUs), or a combination of them that can execute instructions to perform various functions described herein. The processor 170 may receive, through the wireless interface 165, image data describing an image of artificial reality to be rendered, and render the image through the display 175. In some embodiments, the image data from the computing device 110 may be encoded, and the processor 170 may decode the image data to render the image. In some embodiments, the processor 170 receives, from the computing device 110 through the wireless interface 165, object information indicating virtual objects in the artificial reality space and depth information indicating depth (or distances from the HWD 150) of the virtual objects. In one aspect, according to the image of the artificial reality, object information, depth information from the computing device 110, and/or updated sensor measurements from the sensors 155, the processor 170 may perform shading, reprojection, and/or blending to update the image of the artificial reality to correspond to the updated location and/or orientation of the HWD 150.

In some embodiments, the display 175 is an electronic component that displays an image. The display 175 may, for example, be a liquid crystal display or an organic light emitting diode display. The display 175 may be a transparent display that allows the user to see through. In some embodiments, when the HWD 150 is worn by a user, the display 175 is located proximate (e.g., less than 3 inches) to the user's eyes. In one aspect, the display 175 emits or projects light towards the user's eyes according to image generated by the processor 170. The HWD 150 may include a lens that allows the user to see the display 175 in a close proximity.

In some embodiments, the processor 170 performs compensation to compensate for any distortions or aberrations. In one aspect, the lens introduces optical aberrations such as a chromatic aberration, a pin-cushion distortion, barrel distortion, etc. The processor 170 may determine a compensation (e.g., predistortion) to apply to the image to be rendered to compensate for the distortions caused by the lens, and apply the determined compensation to the image from the processor 170. The processor 170 may provide the predistorted image to the display 175.

In some embodiments, the computing device 110 is an electronic component or a combination of an electronic component and a software component that provides content to be rendered to the HWD 150. The computing device 110 may be embodied as a mobile device (e.g., smart phone, tablet PC, laptop, etc.). The computing device 110 may operate as a soft access point. In one aspect, the computing device 110 includes a wireless interface 115 and a processor 118. These components may operate together to determine a view (e.g., a FOV of the user) of the artificial reality corresponding to the location of the HWD 150 and the gaze direction of the user of the HWD 150, and can generate image data indicating an image of the artificial reality corresponding to the determined view. The computing device 110 may also communicate with the access point 105, and may obtain AR/VR content from the access point 105, for example, through the wireless link 102 (e.g., interlink). The computing device 110 may receive sensor measurement indicating location and the gaze direction of the user of the HWD 150 and provide the image data to the HWD 150 for presentation of the artificial reality, for example, through the wireless link 125 (e.g., intralink). In other embodiments, the computing device 110 includes more, fewer, or different components than shown in FIG. 1.

In some embodiments, the wireless interface 115 is an electronic component or a combination of an electronic component and a software component that communicates with the HWD 150, the access point 105, other computing device 110, or any combination of them. In some embodiments, the wireless interface 115 includes or is embodied as a transceiver for transmitting and receiving data through a wireless medium. The wireless interface 115 may be a counterpart component to the wireless interface 165 to communicate with the HWD 150 through a wireless link 125 (e.g., intralink). The wireless interface 115 may also include a component to communicate with the access point 105 through a wireless link 102 (e.g., interlink). Examples of wireless link 102 include a cellular communication link, a near field communication link, Wi-Fi, Bluetooth, 60 GHz wireless link, or any wireless communication link. The wireless interface 115 may also include a component to communicate with a different computing device 110 through a wireless link 185. Examples of the wireless link 185 include a near field communication link, Wi-Fi direct, Bluetooth, or any wireless communication link. Through the wireless link 102 (e.g., interlink), the wireless interface 115 may obtain AR/VR content, or other content from the access point 105. Through the wireless link 125 (e.g., intralink), the wireless interface 115 may receive from the HWD 150 data indicating the determined location and/or orientation of the HWD 150, the determined gaze direction of the user, and/or the hand tracking measurement. Moreover, through the wireless link 125 (e.g., intralink), the wireless interface 115 may transmit to the HWD 150 image data describing an image to be rendered. Through the wireless link 185, the wireless interface 115 may receive or transmit information indicating the wireless link 125 (e.g., channel, timing) between the computing device 110 and the HWD 150. According to the information indicating the wireless link 125, computing devices 110 may coordinate or schedule operations to avoid interference or collisions.

The processor 118 can include or correspond to a component that generates content to be rendered according to the location and/or orientation of the HWD 150. In some embodiments, the processor 118 includes or is embodied as one or more central processing units, graphics processing units, image processors, or any processors for generating images of the artificial reality. In some embodiments, the processor 118 may incorporate the gaze direction of the user of the HWD 150 and a user interaction in the artificial reality to generate the content to be rendered. In one aspect, the processor 118 determines a view of the artificial reality according to the location and/or orientation of the HWD 150. For example, the processor 118 maps the location of the HWD 150 in a physical space to a location within an artificial reality space, and determines a view of the artificial reality space along a direction corresponding to the mapped orientation from the mapped location in the artificial reality space. The processor 118 may generate image data describing an image of the determined view of the artificial reality space, and transmit the image data to the HWD 150 through the wireless interface 115. The processor 118 may encode the image data describing the image, and can transmit the encoded data to the HWD 150. In some embodiments, the processor 118 generates and provides the image data to the HWD 150 periodically (e.g., every 11 ms or 16 ms).

In some embodiments, the processors 118, 170 may configure or cause the wireless interfaces 115, 165 to toggle, transition, cycle or switch between a sleep mode and a wake up mode. In the wake up mode, the processor 118 may enable the wireless interface 115 and the processor 170 may enable the wireless interface 165, such that the wireless interfaces 115, 165 may exchange data. In the sleep mode, the processor 118 may disable (e.g., implement low power operation in) the wireless interface 115 and the processor 170 may disable the wireless interface 165, such that the wireless interfaces 115, 165 may not consume power or may reduce power consumption. The processors 118, 170 may schedule the wireless interfaces 115, 165 to switch between the sleep mode and the wake up mode periodically every frame time (e.g., 11 ms or 16 ms). For example, the wireless interfaces 115, 165 may operate in the wake up mode for 2 ms of the frame time, and the wireless interfaces 115, 165 may operate in the sleep mode for the remainder (e.g., 9 ms) of the frame time. By disabling the wireless interfaces 115, 165 in the sleep mode, power consumption of the computing device 110 and the HWD 150 can be reduced.

Figure 2:
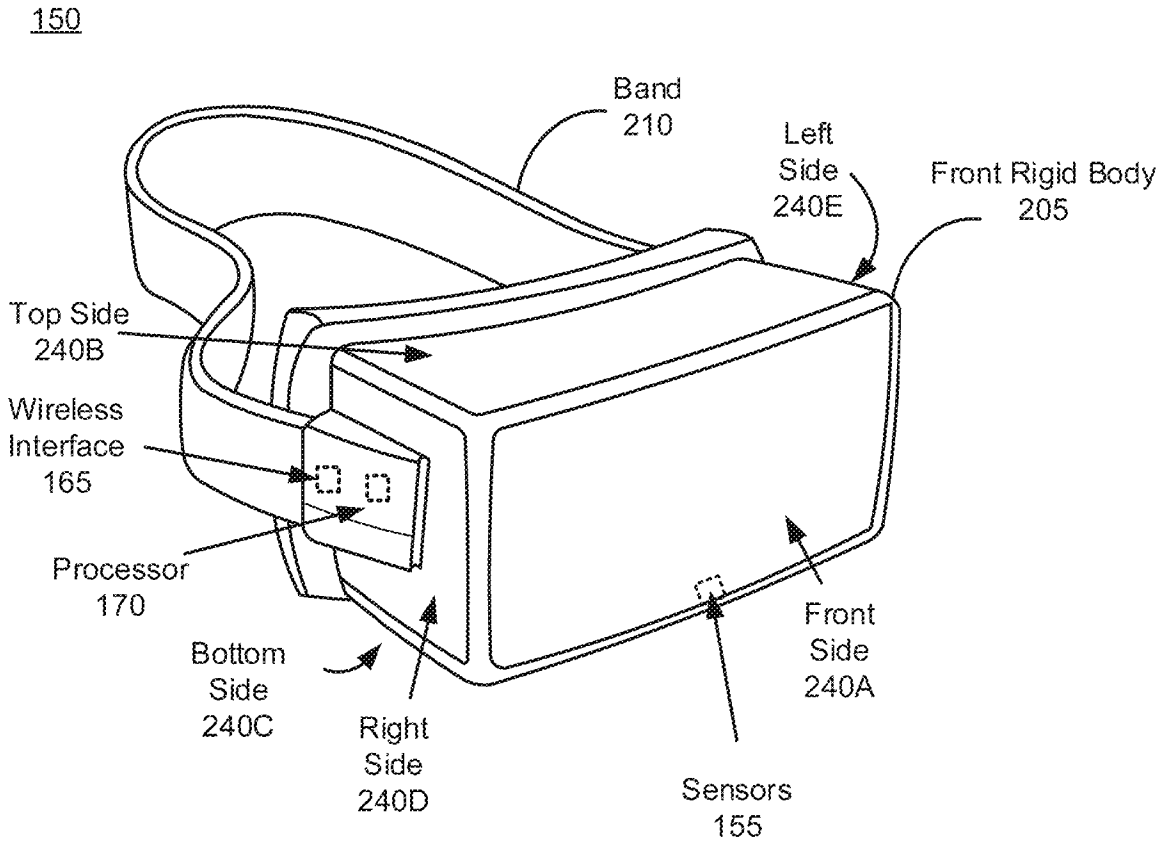
FIG. 2 is a diagram of a head wearable display, according to an example implementation of the present disclosure.

FIG. 2 is a diagram of a HWD 150, in accordance with an example embodiment. In some embodiments, the HWD 150 includes a front rigid body 205 and a band 210. The front rigid body 205 includes the display 175 (not shown in FIG. 2), the lens (not shown in FIG. 2), the sensors 155, the wireless interface 165, and the processor 170. In the embodiment shown by FIG. 2, the wireless interface 165, the processor 170, and the sensors 155 are located within the front rigid body 205, and may not visible to the user. In other embodiments, the HWD 150 has a different configuration than shown in FIG. 2. For example, the wireless interface 165, the processor 170, and/or the sensors 155 may be in different locations than shown in FIG. 2.

Figure 3:
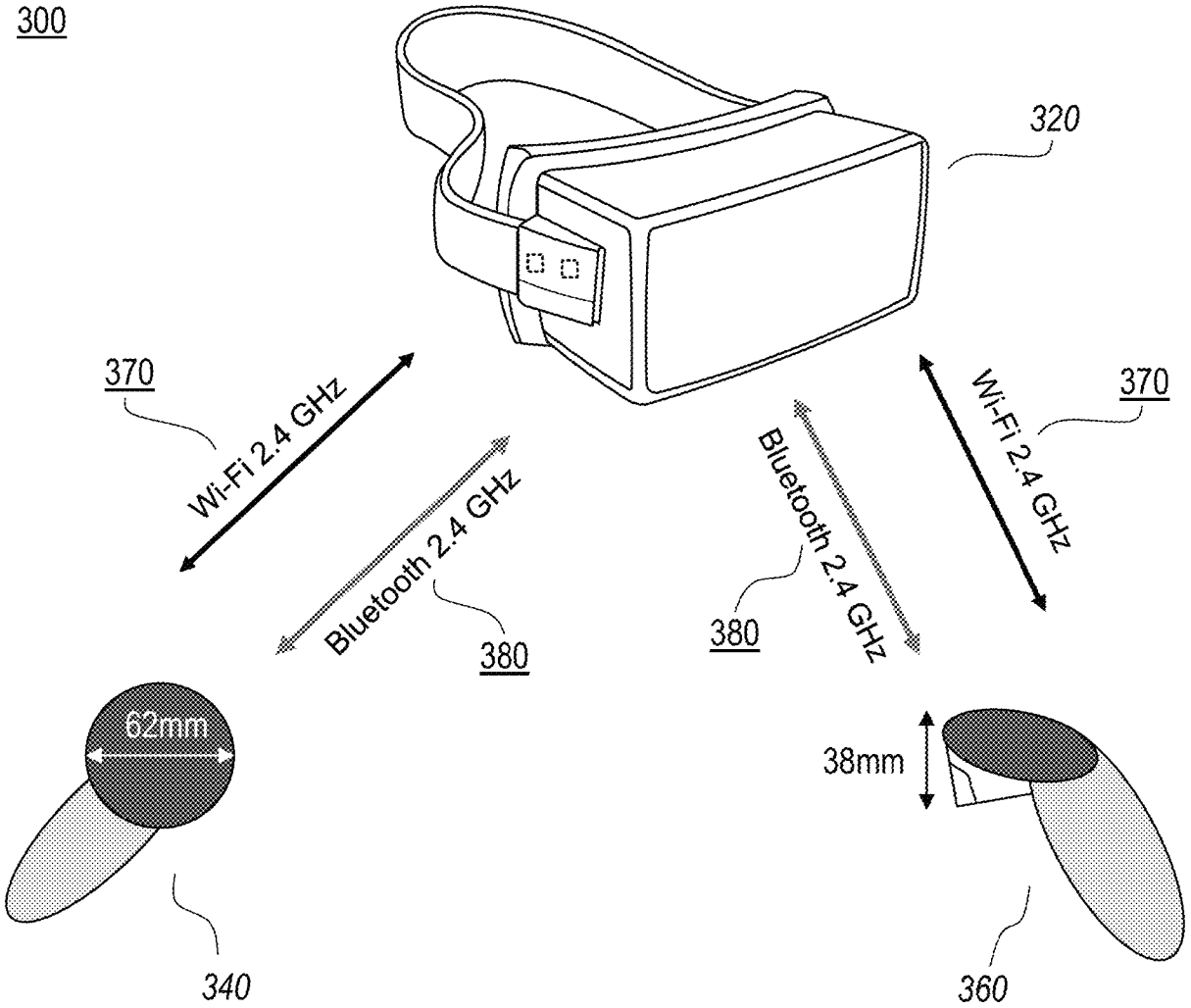
FIG. 3 is a diagram of communicating over multiple wireless links without time division duplexing, according to an example implementation of the present disclosure.

One problem relates to improving throughput and user experience in communications between wireless devices where each device has multiple antennas and a time division duplexing (TDD) is not possible. For example, FIG. 3 illustrates a wireless environment 300 in which two wireless devices 340, 360 communicate with a wireless device 320 over multiple wireless links 370, 380, according to an example implementation of the present disclosure. The wireless device 320 may be a HWD for instance, which has configurations similar to those of HWDs 150A, 150B, 150 (see FIG. 1 and FIG. 2) and is configured to perform wireless communication over multiple wireless links including a Wi-Fi link 370 and a Bluetooth link 380 (e.g., Bluetooth Low Energy (BLE) link). Each wireless device 340, 360 may be a handheld controller which can include multiple antennas (including at least a Wi-Fi antenna and a Bluetooth antenna) so that the wireless device can communicate with the HWD 320 over the Wi-Fi link 370 and the Bluetooth link 380. The controllers 340, 360 may have configurations similar to that of a computing system 1114 (see FIG. 11). In some embodiments, the controllers may be compact (e.g., having dimensions of less than 70 mm as shown in FIG. 3) and each controller includes one or more cameras and one or more batteries. If the two links are time division duplexing (TDD), each link cannot fully utilize its full bandwidth. Therefore, in this environment as shown in FIG. 3 or similar environments (e.g., artificial reality applications), TDD is not likely possible because throughput is important for better user experience.

Another problem relates to improving isolation between antennas (or avoiding crosstalk between antennas) over multiple wireless links when the wireless links operate with the same or similar frequency band(s). For example, referring to FIG. 3, the HWD 320 and the controllers (340, 360) may use a 2.4 GHz Bluetooth link 380 so that the controllers can communicate tracking data with the HWD 320. In some embodiments, this Bluetooth link has stringent requirements in terms of latency (e.g., <2 ms) and is critical for the user experience. Moreover, the controllers 340, 360 may have cameras for inside out tracking so that each controller receives room map data updates from the HWD over a 2.4 GHz Wi-Fi link 370. The two links (Bluetooth link and Wi-Fi link) cannot be shared due to the critical controller latency requirements, as well as the bandwidth requirements for map data. Furthermore, the Wi-Fi and Bluetooth links cannot be TDD (Time Division Duplexing) as they are driven by different radios. Therefore, a possible scenario is that the two wireless links in the same or similar frequency band (2.4 GHz to 2.484 GHz) operates simultaneously. This imposes high isolation requirements between a 2.4 GHz Wi-Fi antenna and a 2.4 GHz BT antenna in each wireless device. For example, when both the Wi-Fi and Bluetooth antennas in the same device operate at the same time (without TDD), one antenna's transmitting operation can de-sensitize the reception on the other antenna. Hence, antenna isolation is essential to reduce the interference or crosstalk between the antennas coexisting in the same device.

In one approach, antenna isolation can be improved using (1) spatial diversity and (2) polarization diversity. For example, spatial diversity can be achieved by increasing a physical separation between antennas (in the same device). However, the controllers 340, 360 in FIG. 3 may have a small form factor because each controller includes one or more cameras and one or more batteries). Moreover, the controller may be a hand-held wireless device having a handle to be gripped by a user. Because the handle normally contains a battery, which is metallic, the antenna cannot be placed in the handle because of lack of antenna volume and significant degradation due to hand covering the antenna. Furthermore, the cameras of the controllers may also be preferably placed where there is no occlusion due to hand grip, which places significant limitations on antenna placement and orientation, while still looking to achieve high antenna isolation. Therefore, spatial diversity between antennas is not likely possible in the controllers shown in FIG. 3.

Polarization diversity can be achieved by using the orthogonality between the electric and magnetic field vectors horizontally or vertically. However, if a device has a small form factor due to inclusion of one or more camera and one or more batteries (e.g., the controllers in FIG. 3), polarization diversity between antennas is not likely possible because (1) complete orthogonality cannot be achieved because of small form factor, (2) a user hand may change the polarity, and (3) metals of the cameras or batteries may function as reflector.

To solve these problems, according to certain aspects, embodiments in the present disclosure relate to techniques for improving antenna isolation using parasitic element. In a wireless device, a parasitic element (or parasitic antenna element) may be placed on and/or terminated with a ground plane via at least one of a resistive element, a reactive element, an open circuit, a short circuit, or any combination or one or more of any of the foregoing, thereby increasing the isolation between the radios operating in the same frequency band. The parasitic element may be formed as a part of an existing printed circuit board (PCB) and hence the cost to bill of materials (BOM) can be negligible. The parasitic element may be placed and designed such that the energy from one (main) antenna couples to the parasitic element instead of coupling to the other (main) antenna, hence improving the antenna isolation. In some embodiments, a main antenna which has a feed connected to a transmitter or a receiver may be of any antenna type, including flex (flexible circuit) antenna, dipole antenna, alias antenna, printed antenna, or a combination thereof. Similarly, a parasitic element may be of any antenna type, including flex (flexible circuit) antenna, dipole antenna, alias antenna, printed antenna, or a combination thereof, except that its feed may not be connected to a transmitter or a receiver, thereby allowing the parasitic element to couple with radiation indirectly. In some embodiments, the parasitic element may be implemented with a simple metal structure. The parasitic element may be of the same type as that of a main antenna and/or have a shape similar to that of a main antenna, but embodiments are not limited thereto. In some embodiments, the parasitic element is not necessarily of the same type as that of a main antenna and does not necessarily have a shape similar to that of a main antenna.

According to certain aspects, embodiments in the present disclosure relate to techniques for mounting a parasitic element on a ground plane of a wireless device different from one or more ground planes of the antennas of the wireless device. In some embodiments, the parasitic element may be formed in/on a PCB different from PCBs in which main antennas are formed or installed. For example, separate first and second ground planes of the wireless device may be formed on respective PCBs of the wireless device such that a port/feed of a first main antenna is connected to the first ground plane while a port/feed of a second main antenna and a port/feed of a parasitic element are connected (or referenced) to the second ground plane. The parasitic element may be mounted on a ground plane different from a ground plane on which the first main antenna is mounted, such that the parasitic element resonates with the first antenna. In some embodiments, the device may include the first main antenna, the second main antenna, and the parasitic element such that the parasitic element is mounted on a PCB between a PCB of the first antenna and a PCB of the second antenna. With these configurations, (1) a ground plane for a first main antenna and (2) a ground plane for a parasitic element and/or a second main antennas are separated, thereby improving isolation between the first and second main antennas by (1) reducing the surface currents that are directly flowing between the first and second main antennas (and/or the first and second ground planes), and (2) providing more flexibility for signal and cable routing. In these embodiments, rather than spatially separating the antennas or using different polarizations for the antennas, the device can use a parasitic element to achieve antenna isolation of for instance 5 dB more than a configuration without using a parasitic element.

According to certain aspects, embodiments in the present disclosure relate to techniques for controlling antenna isolation by connecting a parasitic element to a switch so as to terminate the parasitic element (e.g., terminate the parasitic element with a ground plane). For example, the switch can terminate the parasitic element via at least one of an inductor, a capacitor, a variable resistor, a short circuit or an open-circuit, or any combination of any number of the foregoing elements. The switch may have one side connected to a parasitic element, and have another side connected to a ground plane via at least one of an inductor, a capacitor, a variable resistor, a short circuit or an open-circuit, or any combination of any number of the foregoing elements. In some embodiments, a wireless device may have a plurality of switches, each connecting a respective parasitic antenna to a ground plane via at least one of an inductor, a capacitor, a variable resistor, a short circuit or an open-circuit, or any combination of any number of the foregoing elements. In some embodiments, the switch may be a single-pole four-throw (SP4T) switch. In some embodiments, a port of a parasitic antenna element may be connected to a pole of a SP4T switch whose four throws are connected to an inductor, a capacitor, a variable resistor, a short circuit, respectively. With these configurations, the type of termination can play a significant role in the power reflected or accepted from a main antenna. Hence, the isolation can be further improved by selection of a proper termination type of a parasitic element. Moreover, selection of a proper termination can improve antenna isolation by allowing for (1) fine-tuning the maximum isolation and (2) adapting to changes in other sub-system components such as, cameras, camera bracket, thumbstick, flexes (or flexible materials), etc.

According to certain aspects, embodiments in the present disclosure relate to techniques for connecting a parasitic element to a variable phase shifter before being terminated with a ground plane. In some embodiments, a port of a parasitic antenna element may be connected to a variable phase shifter which is connected to a ground plane. In some embodiments, the ground plane connected to the variable phase shifter may be a ground plane to which a feed of one of the main antennas is connected, different from ground planes to which feeds of other main antennas are connected. With these configurations, a phase shifter can provide an option to modify the phase of a signal that is terminated and reflected from the parasitic element, thereby providing flexibility to modify or adjust the isolation response.

According to certain aspects, embodiments in the present disclosure relate to techniques for controlling antenna isolation by (1) connecting a parasitic element to a variable phase shifter and (2) connecting the variable phase shifter to a switch so as to terminate with a ground plane via a plurality of termination options. For example, the parasitic element may be connected to one terminal of a variable phase shifter, the other terminal of the variable phase shifter may be connected to one side of a switch. The switch may have another side connected to a ground plane via at least one of termination options, e.g., an inductor, a capacitor, a variable resistor, a short circuit or an open-circuit, or any combination of any number of the foregoing elements, so that the switch can terminate the parasitic element with a ground plane via at least one of the termination options. In some embodiments, the switch may be a SP4T switch. In some embodiments, the other terminal of the variable phase shifter may be connected to a pole of a SP4T switch whose four throws are connected to for example, an inductor, a capacitor, a variable resistor, a short circuit, respectively. With these configurations, addition of a phase shifter to a switch (for termination) can provide an additional tuning knob and even more flexibility to achieve high isolation in a small form-factor device.

According to certain aspects, embodiments in the present disclosure relate to techniques for tuning a parasitic element over multiple frequency bands to resonate with at least one of the main antennas. In some embodiments, a wireless device includes a tuner circuit connected to a parasitic element to adjust a resonance frequency of the parasitic element to a frequency of interest. For example, the tuner circuit can adjust the resonance frequency of the parasitic element such that the parasitic element resonates with a first main antenna in a 2.4 GHz band to prevent the first antenna from being coupled to (or resonate with) a second main antenna mounted on the same device which operates in the 2.4 GHz band. In some embodiments, the first main antenna, the second main antenna and the parasitic element may be connected to a first tuner, a second tuner and a third tuner, respectively. In some embodiments, a feed of the first main antenna, a feed of the second main antenna and a feed of the parasitic element may be connected to the first tuner, the second tuner and the third tuner, respectively. The first, second, and third tuners may be adjusted to configure the first antenna, the second antenna and the parasitic element, respectively, to achieve the same resonant frequency. In some embodiments, the wireless device includes a modem circuit configured to control the first, second and third tuners via clock and/or controller signals. In some embodiments, the modem circuit is a modem system-on-chip (SoC). Each of the tuner circuit, the first tuner, second tuner and the third tuner may be an antenna tuner, an impedance tuner, an impedance matching unit, a matching network, an antenna tuning unit (ATU), an antenna coupler, or a feedline coupler. In some embodiments, a tuner circuit connected to a parasitic element may be configured to select a band of a particular antenna among a plurality of frequency bands, thereby operating in a plurality of tuner states. In some embodiments, the plurality of frequency bands include frequency bands specified in the standards of Wi-Fi, Bluetooth, BLE, Cellular, or Long-Term Evolution (LTE), etc. In some embodiments, the plurality of frequency bands may include a low band (600-960 MHz), a middle band (1.4-2.7 GHz), and a high band (3.4-4.8 GHz). In some embodiments, the plurality of frequency bands may include a first band (600-960 MHz), a second band (1.4-2.2 GHz), a third band (2.3-2.7 GHz), and a fourth band (3.4-4.8 GHz). With these configurations, the parasitic element can improve antenna isolation not only at a specific frequency band (e.g., 2.4 GHz band for Wi-Fi/BLE) but also at different bands (e.g., cellular band). By connecting the parasitic element to a tuner and synchronizing with other tuners for main antennas, the same parasitic element can improve antenna isolation in a plurality of frequency bands (Wi-Fi, Bluetooth, BLE, Cellular, or LTE, etc.) supported by the system. Moreover, because main antennas already have corresponding tuners, addition of only one additional tuner corresponding to the parasitic element can improve antenna isolation in a plurality of frequency bands.

In some embodiments, a wireless device may improve antenna isolation by using a signal cancellation circuit configured to perform signal combination and/or cancellation so that one or more signals from one or more main antennas can be canceled. In some embodiments, the signal cancellation circuit can check or determine a maximum possible isolation by signal cancellation, and cancel signals based the maximum possible isolation.

A wireless device may include a first antenna configured to perform wireless communication, a second antenna configured to perform wireless communication, and a parasitic antenna. The first antenna may have a feed connected to a first impedance tuner that is connected to a first ground plane. The second antenna may have a feed connected to a second impedance tuner. The parasitic antenna may be disposed between the first and second antennas, with a feed connected to a third impedance tuner that is connected to a second/different ground plane. The first, second and third impedance tuners may be adjusted to configure the first, second and parasitic antennas to achieve (substantially) a same resonant frequency.

In some embodiments, the first antenna and the first ground plane may be implemented on a first printed circuit board (PCB). The parasitic antenna and the second ground plane may be implemented on a second printed circuit board (PCB). The first PCB and the second PCB may be substantially parallel to each other on different planes. A primary surface of the second antenna may be on a plane that is angled relative to (and different from and/or non-parallel to) the planes of the first PCB and the second PCB.

In some embodiments, the wireless device may include a controller configured to adjust the first, second and third impedance tuners to configure the first, second and parasitic antennas to achieve the same resonant frequency. In some embodiments, the wireless device comprises a handheld controller device.

In some embodiments, the first, second and third impedance tuners may be adjusted at a first time to configure the first, second and parasitic antennas to achieve a first resonant frequency. The first, second and third impedance tuners may be adjusted at a second time (e.g., different from the first time) to configure the first, second and parasitic antennas to achieve a second resonant frequency.

In some embodiments, the first antenna and the second antenna may be configured to perform wireless communication with a same head wearable device. The first antenna and the second antenna may be configured to perform wireless communication at a same operating frequency with the same head wearable device. The first antenna may be configured to perform wireless communication with the head wearable device using a first wireless communication protocol. The first antenna may be configured to perform wireless communication with the head wearable device using a second wireless communication protocol different from the first wireless communication protocol.

Embodiments in the present disclosure can have the following advantages.

First, some embodiments can provide useful techniques for preventing one antenna from being coupled to (or resonating with) another antenna in a wireless device using a parasitic element, without having to increase the physical separation between the antennas or changing polarizations of the antennas (e.g., to be orthogonal). For example, (1) a ground plane for a first main antenna and (2) a ground plane for a parasitic element and a second main antennas are separated, thereby improving isolation between the first and second main antennas by (1) reducing the surface currents that are directly flowing between the first and second main antennas, and (2) providing more flexibility for signal and cable routing.

Second, some embodiments can provide useful techniques for improve antenna isolation by selecting a proper termination type of a parasitic element so as to change the power reflected or accepted from a main antenna. These techniques can (1) fine tune the maximum isolation and (2) adapt to changes in other sub-system components such as, cameras, camera bracket, thumb stick, flexes (or flexible materials), etc.

Third, some embodiments can provide useful techniques for connecting a parasitic element to a phase shifter. These techniques can provide an option to modify the phase of a signal that is terminated and reflected from the parasitic element, thereby providing flexibility to modify or adjust the isolation response.

Fourth, some embodiments can provide useful techniques for tuning a parasitic element over multiple frequency bands to resonate with at least one of main antennas. These techniques can improve antenna isolation not only at a specific frequency band (e.g., 2.4 GHz band for Wi-Fi/BLE) but also at different bands (e.g., cellular band). By connecting the parasitic element to a tuner and synchronizing with other tuners for main antennas, the same parasitic element can improve antenna isolation in a plurality of frequency bands (Wi-Fi, Bluetooth, BLE, Cellular, or LTE, etc.) supported by the system. Moreover, because main antennas already have corresponding tuners, addition of only one additional tuner corresponding to the parasitic element can improve antenna isolation in a plurality of frequency bands.

Figure 4:
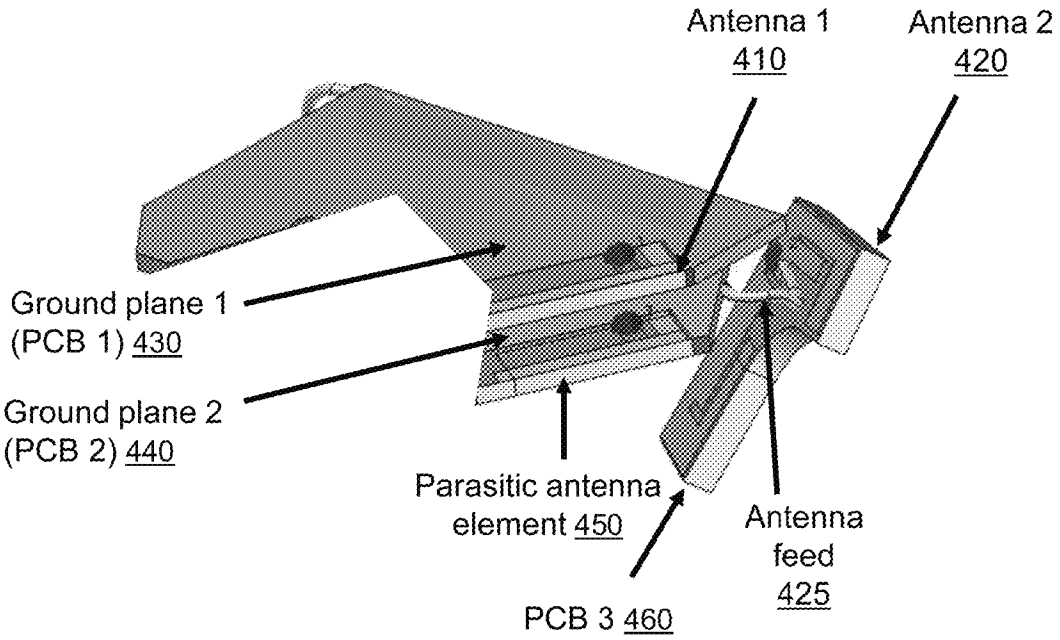
FIG. 4 is a diagram of an embodiment of antenna isolation with one or more parasitic elements using separate ground planes, according to an example implementation of the present disclosure.

FIG. 4 is a diagram of an embodiment of antenna isolation with one or more parasitic elements using separate ground planes, according to an example implementation of the present disclosure. Referring to FIG. 4, a wireless device (e.g., controller 340, 360 in FIG. 3) includes an apparatus 400 for antenna isolation. The apparatus 400 may include a first main antenna 410 formed or installed on a first PCB 430 which functions as a first ground plane, a parasitic antenna element (or parasitic element) 450 formed or installed on a second PCB 440 which functions as a second ground plane, and a second main antenna 420 formed or installed on a third PCB 460.

Referring to FIG. 4, a parasitic element (e.g., parasitic element 450) may be mounted on a ground plane (e.g., ground plane 440) which is different or separate from one or more ground planes (e.g., ground plane 430) on which one or more main antennas (e.g., first main antenna 430) are mounted. The parasitic element may be formed in a PCB (e.g., second PCB 440) different from PCBs (e.g., first and third PCBs 430 and 460) in which main antennas (e.g., first and second main antennas 410, 420) are formed or installed. In some embodiments, a port of the first main antenna (e.g., first main antenna 410) is connected to the first ground plane (e.g., first ground plane 430) while a feed of the second main antenna (e.g., a feed 425 of second antenna 420) and a port of the parasitic element (e.g., parasitic element 450) are connected (or referenced) to the second ground plane (e.g., second ground plane 440). The parasitic element may be mounted on a ground plane different from a ground plane on which the first main antenna is mounted, such that the parasitic element resonates with the first antenna. In some embodiments, the device may include the first main antenna, the second main antenna, and the parasitic element such that the parasitic element (e.g., parasitic element 450) is mounted on a PCB (e.g., second PCB 440) between a PCB of the first antenna (e.g., first PCB 430) and a PCB of the second antenna (e.g., third PCB 460). With these configurations, (1) a ground plane for the first main antenna (e.g., first ground plane 430) and (2) a ground plane for the parasitic element and the second main antennas (e.g., second ground plane 440) are separated/unconnected, thereby improving isolation between the first and second main antennas by (1)

reducing the surface currents that are directly flowing between the first and second main antennas, and (2) providing more flexibility for signal and cable routing.

Figure 5:
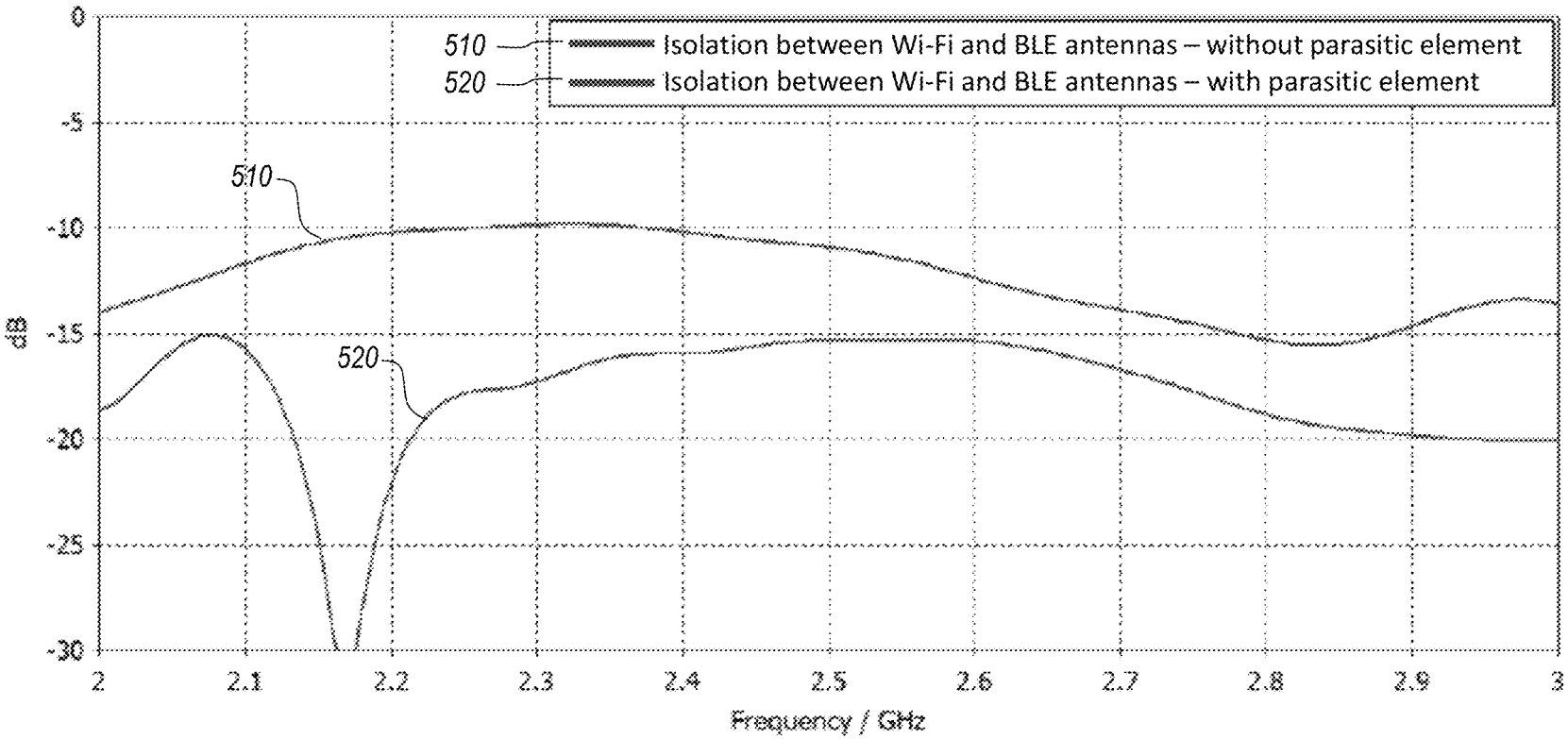
FIG. 5 is a diagram showing performance of antenna isolation with one or more parasitic elements, according to an example implementation of the present disclosure.

FIG. 5 is a diagram showing performance of antenna isolation with one or more parasitic elements, according to an example implementation of the present disclosure. FIG. 5 shows a line/graph/plot 510 indicating a degree of antenna isolation (in dB; more absolute dB values indicating more degrees of isolation) between a Wi-Fi antenna and a BLE antenna over frequency when a wireless device uses no parasitic element, and a line/graph/plot 520 indicating a degree of antenna isolation a Wi-Fi antenna and a BLE antenna over frequency when a wireless device uses a parasitic element similar to the embodiments of FIG. 4. It is shown that the device that uses a parasitic element can achieve antenna isolation 5 dB more than a configuration without using a parasitic element.

Figure 6A:
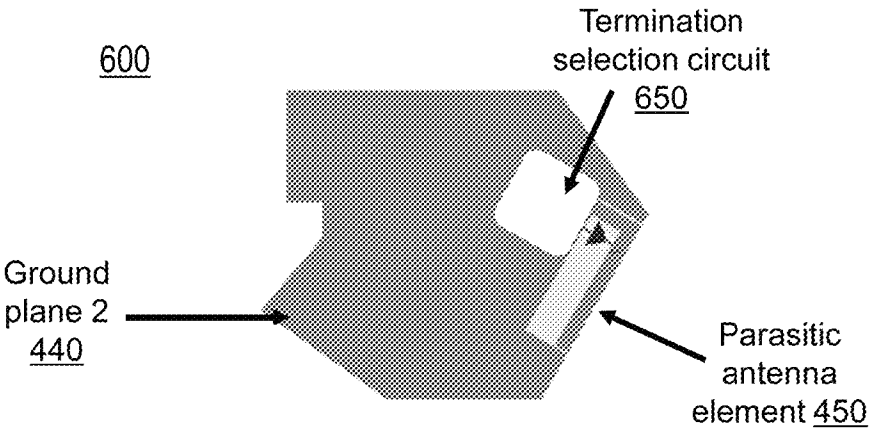
FIG. 6A and FIG. 6B are diagrams of an embodiment of antenna isolation with one or more parasitic elements by parasitic element termination using a switch, according to an example implementation of the present disclosure.
Figure 6B:
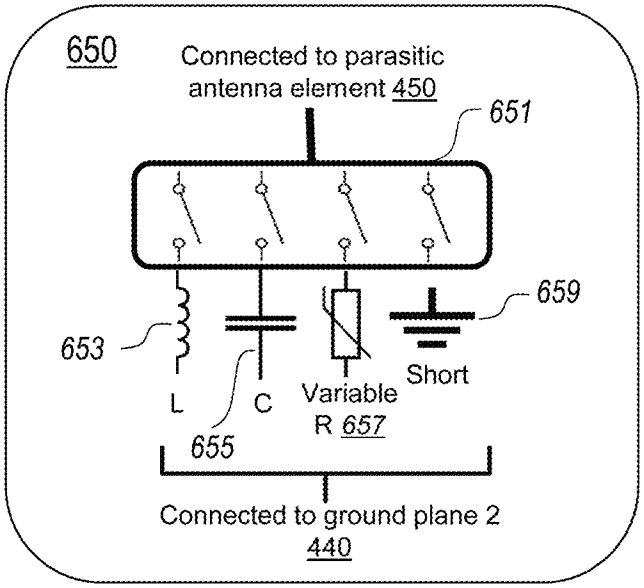

FIG. 6A and FIG. 6B are diagrams of an embodiment of antenna isolation with one or more parasitic elements by parasitic element termination using a switch, according to an example implementation of the present disclosure. Referring to FIG. 6A, a wireless device (e.g., controller 340, 360 in FIG. 3) includes an apparatus 600 for antenna isolation. The apparatus 600 may include a first main antenna 410, a second main antenna 420, a parasitic antenna element (or parasitic element) 450 formed or installed on a second ground plane 440, and a termination selection circuit 650. In some embodiments, the apparatus 600 may have arrangements of PCBs and antenna configurations similar to those of the apparatus 400 (see FIG. 4).

Referring to FIG. 6A and 6B, the termination selection circuit 650 may control (a degree of) antenna isolation by connecting a parasitic element (e.g., parasitic element 450) to a switch (e.g., switch 641) so as to terminate the parasitic element (e.g., terminate the parasitic element with a ground plane). For example, the switch can terminate the parasitic element via at least one of an inductor (e.g., inductor 653), a capacitor (e.g., capacitor 655), a variable resistor (e.g., variable resistor 657), a short circuit (e.g., a short circuit 659 referenced to the second ground plane 440) or an open-circuit (not shown), or any combination or any number of any one or more of the foregoing elements. The switch may have one side connected to the parasitic element, and have another side connected to a ground plane (e.g., second ground plane 440) via at least one of an inductor, a capacitor, a variable resistor, a short circuit or an open-circuit or any combination or any number of any one or more of the foregoing elements. In some embodiments, a wireless device (e.g., controller 340, 360) may have a plurality of switches, each connecting a respective parasitic antenna to a ground plane via at least one of an inductor, a capacitor, a variable resistor, a short circuit or an open-circuit or any combination or any number of any one or more of the foregoing elements. In some embodiments, the switch may be a single-pole four-throw (SP4T) switch. For example, a port of a parasitic antenna element (e.g., parasitic element 450) may be connected to a pole of a SP4T switch whose four throws are for example connected to an inductor, a capacitor, a variable resistor, a short circuit, respectively. With these configurations, the type of termination can play a significant role in the power reflected or accepted from a main antenna. Hence, the isolation can be further improved by selection of a proper termination type of a parasitic element. Moreover, selection of a proper termination can improve antenna isolation by allowing for (1) fine-tuning the maximum isolation and (2) adapting to changes in other sub-system components such as, cameras, camera bracket, thumbstick, flexes (or flexible materials), etc.

Figure 7A:
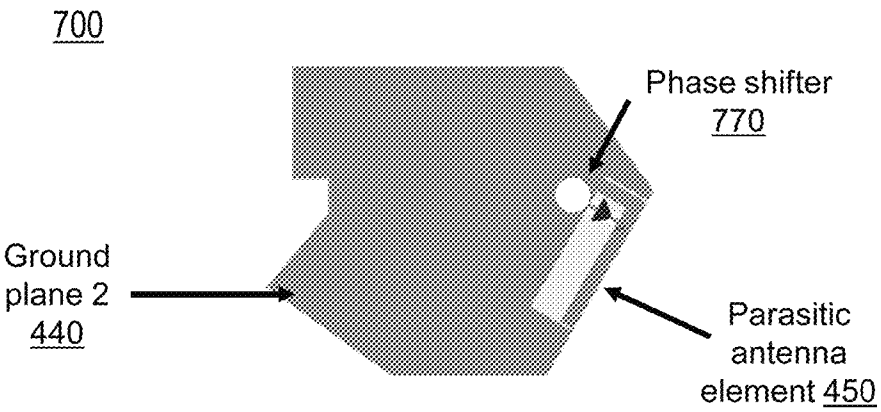
FIG. 7A and FIG. 7B are diagrams of an embodiment of antenna isolation with one or more parasitic elements using a phase shifter, according to an example implementation of the present disclosure.
Figure 7B:
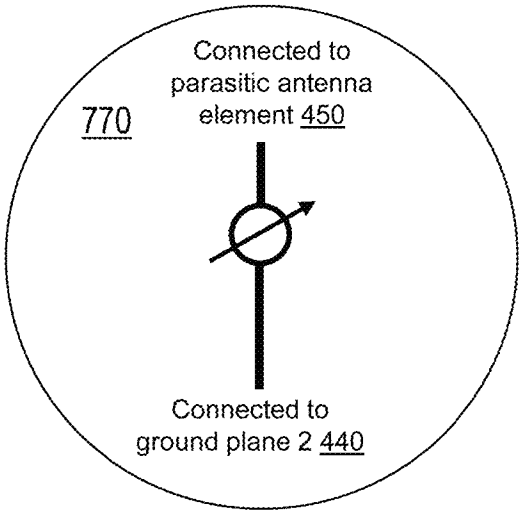

FIG. 7A and FIG. 7B are diagrams of an embodiment of antenna isolation with one or more parasitic elements using a phase shifter, according to an example implementation of the present disclosure. Referring to FIG. 7A, a wireless device (e.g., controller 340, 360 in FIG. 3) includes an apparatus 700 for antenna isolation. The apparatus 700 (or device) may include a first main antenna 410, a second main antenna 420, a parasitic antenna element (or parasitic element) 450 formed or installed on a second ground plane 440, and/or a variable phase shifter 770. In some embodiments, the apparatus 700 may have arrangements of PCBs and antenna configurations similar to those of the apparatus 400 (see FIG. 4).

Referring to FIG. 7A and 7B, the apparatus 700 may connect a parasitic element (e.g., parasitic element 450) to a variable phase shifter (e.g., variable phase shifter 770) before being terminated with a ground plane (e.g., second ground plane 440). A port of the parasitic antenna element may be connected to the variable phase shifter which is connected to the ground plane. In some embodiments, the ground plane connected to the variable phase shifter may be a ground plane (e.g., second ground plane 440) to which a feed of one of the main antennas (e.g., feed 425 of second antenna 420) is connected, different from ground planes (e.g., first ground plane 430) to which feeds of other main antennas (e.g., first main antenna 410) are connected. With these configurations, a phase shifter can provide an option to modify the phase of a signal that is terminated and reflected from the parasitic element, thereby providing flexibility to modify or adjust the isolation response.

Figure 8A:
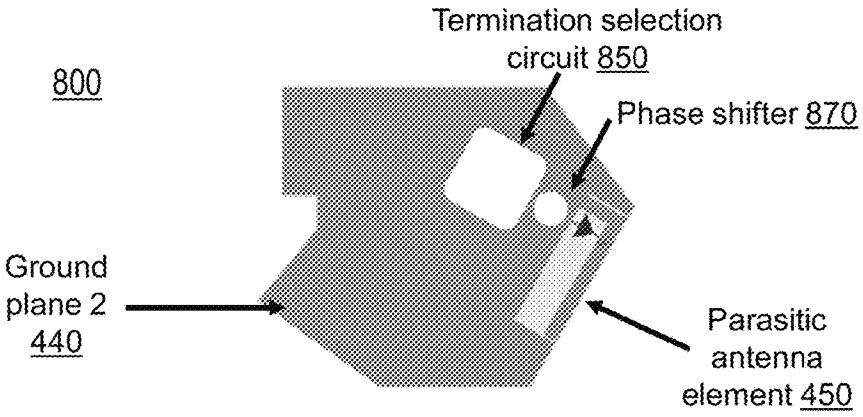
FIG. 8A and FIG. 8B are diagrams of an embodiment of antenna isolation with one or more parasitic elements using parasitic element termination with a phase shifter, according to an example implementation of the present disclosure.
Figure 8B:
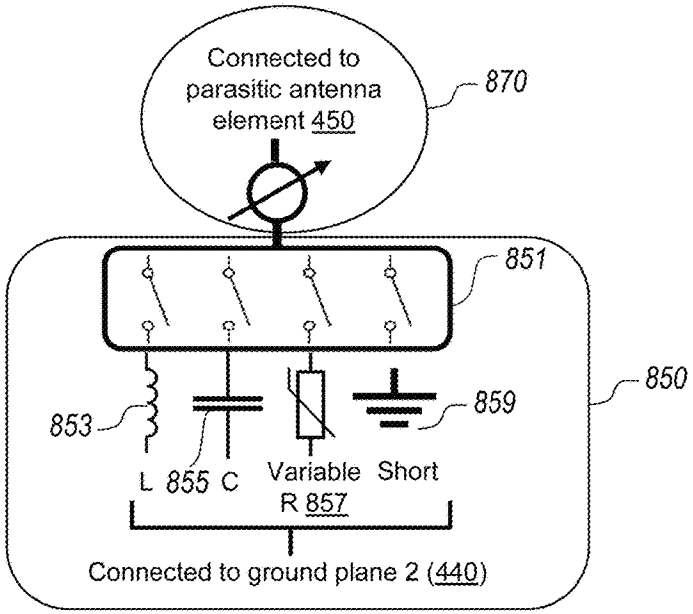

FIG. 8A and FIG. 8B are diagrams of an embodiment of antenna isolation with one or more parasitic elements using parasitic element termination with a phase shifter, according to an example implementation of the present disclosure. Referring to FIG. 8A, a wireless device (e.g., controller 340, 360 in FIG. 3) includes an apparatus 800 for antenna isolation. The apparatus 800 may include a first main antenna 410, a second main antenna 420, a parasitic antenna element (or parasitic element) 450 formed or installed on a second ground plane 440, a termination selection circuit 850, and a variable phase shifter 870. In some embodiments, the termination selection circuit 850 and the variable phase shifter 870 may have configurations similar to those of the termination selection circuit 650 (see FIG. 6) and the variable phase shifter 770 (see FIG. 7), respectively. In some embodiments, the apparatus 800 may have arrangements of PCBs and antenna configurations similar to those of the apparatus 400 (see FIG. 4).

Referring to FIG. 8A and FIG. 8B, the apparatus 800 may control antenna isolation by (1) connecting a parasitic element (e.g., parasitic element 450) to a variable phase shifter (e.g., variable phase shifter 870) and (2) connecting the variable phase shifter to a switch (e.g., switch 851 in termination selection circuit 850) so as to terminate with a ground plane (e.g., second ground plane 440) via a plurality of termination options. For example, the parasitic element may be connected to one terminal of the variable phase shifter, the other terminal of the variable phase shifter may be connected to one side of the switch in the termination selection circuit. The switch may have another side connected to a ground plane via at least one of termination options including an inductor (e.g., inductor 853), a capacitor (e.g., capacitor 855), a variable resistor (e.g., variable resistor 857), a short circuit (e.g., short circuit 859) or an open-circuit (not shown), so that the switch can terminate the parasitic element with a ground plane via at least one of the termination options. In some embodiments, the switch may be a SP4T switch. In some embodiments, the other terminal of the variable phase shifter may be connected to a pole of a SP4T switch whose four throws are connected to the inductor, the capacitor, the variable resistor, the short circuit, respectively. With these configurations, addition of a phase shifter to a switch (for termination) can provide an additional tuning knob and even more flexibility to achieve high isolation in a small form-factor device, compared to the embodiments of FIG. 6A to FIG. 7B.

Figure 9A:
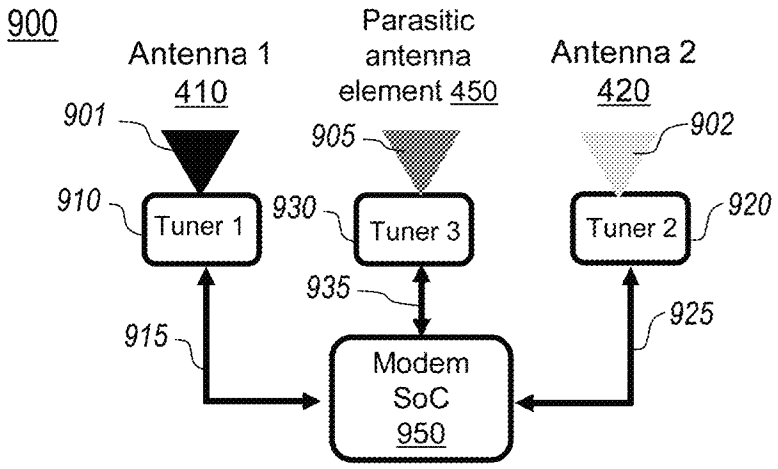
FIG. 9A and FIG. 9B are diagrams of an embodiment of antenna isolation with one or more multiband parasitic elements with a tuner, according to an example implementation of the present disclosure.
Figure 9B:
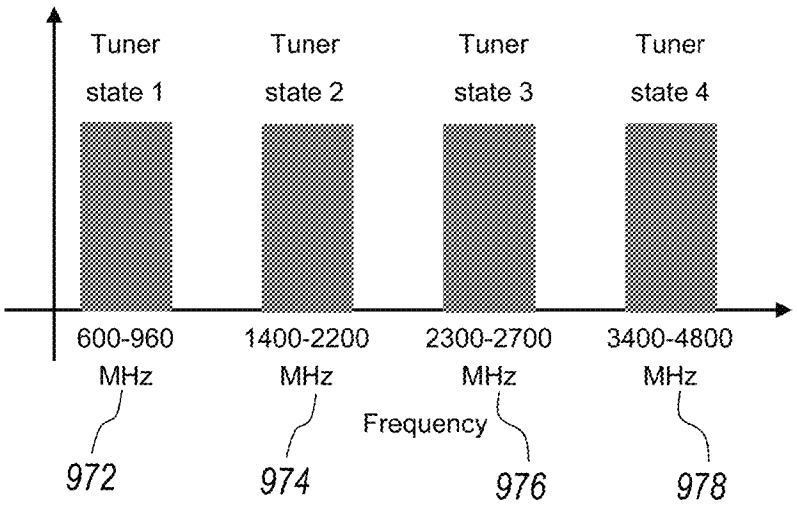

FIG. 9A and FIG. 9B are diagrams of an embodiment of antenna isolation with one or more multiband parasitic elements with a tuner, according to an example implementation of the present disclosure. Referring to FIG. 9A, a wireless device (e.g., controller 340, 360 in FIG. 3) includes an apparatus 900 for antenna isolation. The apparatus 900 may include a first main antenna 410, a second main antenna 420, a parasitic antenna element (or parasitic element) 450, a first tuner 910, a second tuner 920, a third tuner 930, and a modem circuit 950.

Referring to FIG. 9A and FIG. 9B, the apparatus 900 may tune a parasitic element (e.g., parasitic element 450) over multiple frequency bands (e.g., frequency bands 972, 974, 976, 978) to resonate with at least one of main antennas (e.g., first main antenna 410 or second main antenna 420). In some embodiments, the apparatus 900 includes a tuner circuit (e.g., third tuner 930) connected to a parasitic element (e.g., parasitic element 450) to adjust a resonance frequency of the parasitic element to a frequency of interest. For example, the tuner circuit can adjust the resonance frequency of the parasitic element such that the parasitic element resonates with a first main antenna (e.g., first main antenna 410) in a 2.4 GHz band to prevent the first antenna from being coupled to (or resonate with) a second main antenna (e.g., second main antenna 420) mounted on the same device (e.g., controller 340, 360 in FIG. 3) which operates in the 2.4 GHz band. In some embodiments, the first main antenna, the second main antenna and the parasitic element may be connected to a first tuner (e.g., first tuner 910), a second tuner (e.g., second tuner 920) and a third tuner (e.g., third tuner 930), respectively. In some embodiments, a feed 901 of the first main antenna 410, a feed 902 of the second main antenna 420, and a feed 905 of the parasitic element 450 may be connected to the first tuner, the second tuner and the third tuner, respectively. The first, second, and third tuners may be adjusted to configure the first antenna, the second antenna and the parasitic element, respectively, to achieve the same resonant frequency (e.g., 2.4 GHz in the scenario shown in FIG. 3). In some embodiments, the apparatus 900 includes a modem circuit (e.g., modem circuit 950) configured to control the first, second and third tuners via clock and/or controller signals (e.g., signals 915, 925, 935). In some embodiments, the modem circuit is a modem system-on-chip (SoC). Each of the tuner circuit, the first tuner, second tuner and the third tuner may be an antenna tuner, an impedance tuner, an impedance matching unit, a matching network, an antenna tuning unit (ATU), an antenna coupler, or a feedline coupler. In some embodiments, a tuner circuit (e.g., third tuner 930) connected to a parasitic element (e.g., parasitic element 450) may be configured to select a band of a particular antenna (e.g., first main antenna 410) among a plurality of frequency bands (e.g., frequency bands 972, 974, 976, 978), thereby operating in a plurality of tuner states (e.g., tuner states 1-4). In some embodiments, the plurality of frequency bands include frequency bands specified in the standards of Wi-Fi, Bluetooth, BLE, Cellular, or Long-Term Evolution (LTE), etc. In some embodiments, the plurality of frequency bands may include a low band (600-960 MHz), a middle band (1.4-2.7 GHz), and a high band (3.4-4.8 GHz). In some embodiments, the plurality of frequency bands may include a first band 972 (600-960 MHz), a second band 974 (1.4-2.2 GHz), a third band 976 (2.3-2.7 GHz), and a fourth band 978 (3.4-4.8 GHz). With these configurations, the parasitic element can improve antenna isolation not only at a specific frequency band (e.g., 2.4 GHz band for Wi-Fi/BLE; see FIG. 3) but also at different bands (e.g., cellular band). By connecting the parasitic element to a tuner and synchronizing with other tuners for main antennas, the same parasitic element can improve antenna isolation in a plurality of frequency bands supported by the system. Moreover, because main antennas already have corresponding tuners, addition of only one additional tuner corresponding to the parasitic element can improve antenna isolation in a plurality of frequency bands.

Figure 10:
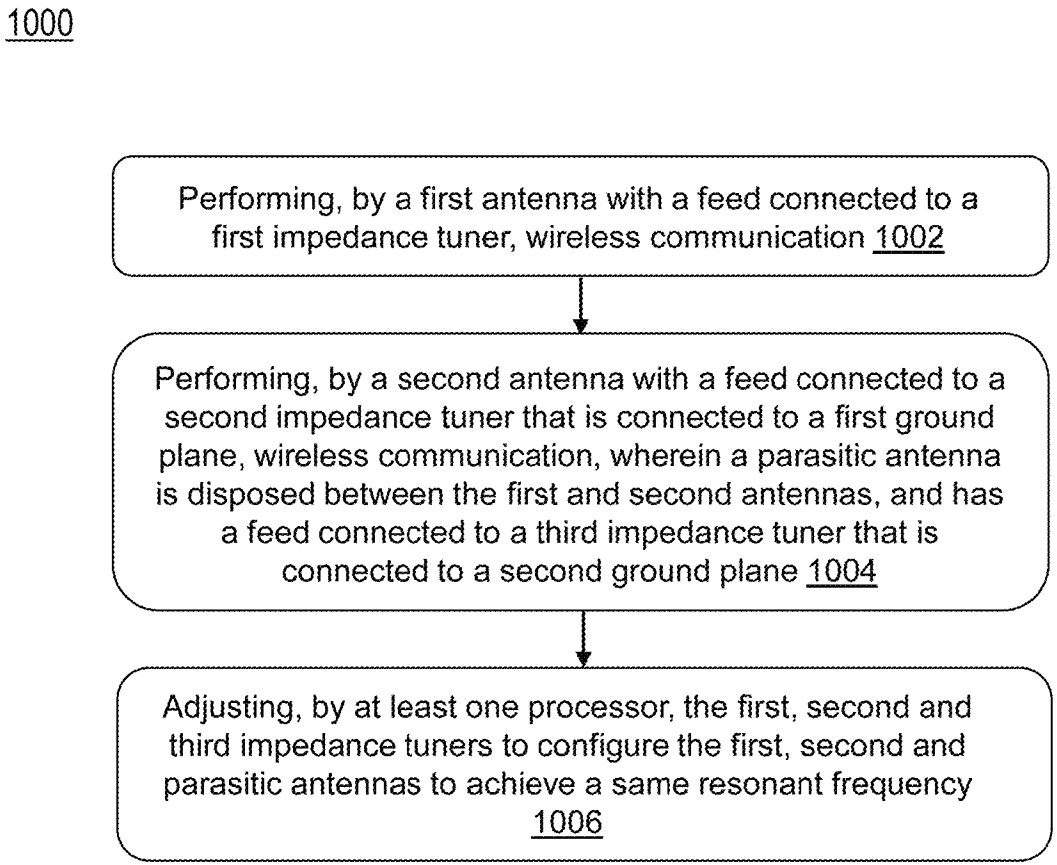
FIG. 10 is a flow chart illustrating a method for improving antenna isolation with one or more parasitic elements, according to another example implementation of the present disclosure.

FIG. 10 is a flowchart showing a process 1000 of improving antenna isolation with one or more parasitic elements (e.g., parasitic element 450 in FIG. 4) in a wireless device (e.g., controller 340, 360 in FIG. 3), according to an example implementation of the present disclosure. In some embodiments, the process 1000 is performed by a controller 340, 360. In some embodiments, the process 1000 is performed by other entities (e.g., HWD 320 in FIG. 3). In some embodiments, the process 1000 includes more, fewer, or different steps than shown in FIG. 10.

In one approach, a first antenna (e.g., first main antenna 410 in FIG. 9A) with a feed (e.g., feed 901 in FIG. 9A) connected to a first impedance tuner (e.g., first tuner 910 in FIG. 9A) that is connected to a first ground plane (e.g., first ground plane 430 in FIG. 4), performs 1002 wireless communication.

In one approach, a second antenna (e.g., second main antenna 420 in FIG. 9A) with a feed (e.g., feed 902 in FIG. 9A) connected to a second impedance tuner (e.g., second tuner 920 in FIG. 9A), performs 1004 wireless communication. A parasitic antenna (e.g., parasitic element 450 in FIG. 4) may be disposed between the first and second antennas (e.g., first and second main antennas 410, 420 in FIG. 4). The parasitic antenna may have a feed (e.g., feed 905 in FIG. 9A) connected to a third impedance tuner (e.g., second tuner 920 in FIG. 9A) that is connected to a second ground plane (e.g., second ground plane 440 in FIG. 4). In some embodiments, the first, second and parasitic antennas are included in a wireless device which comprises a handheld controller device (e.g., controller 340, 360 in FIG. 3).

In some embodiments, the first antenna (e.g., first main antenna of controller 340, 360 in FIG. 3) may performs wireless communication (e.g., Wi-Fi communication over first link 370 in FIG. 3) with a head wearable device (e.g., HWD 320 in FIG. 3). In some embodiments, the second antenna (e.g., first main antenna of controller 340, 360 in FIG. 3) may performs wireless communication (e.g., Bluetooth communication over second link 380 in FIG. 3) with the head wearable device. The first antenna performs wireless communication with the head wearable device at a defined operating frequency (e.g., 2.4 GHz Wi-Fi in FIG. 3). The second antenna may perform wireless communication with the head wearable device at the defined operating frequency (e.g., 2.4 GHz Bluetooth in FIG. 3). The first antenna may perform wireless communication with the head wearable device using a first wireless communication protocol (e.g., Wi-Fi protocol). The second antenna may perform wireless communication with the head wearable device using a second wireless communication protocol (e.g., Bluetooth protocol) different from the first wireless communication protocol.

In some embodiments, the first antenna (e.g., first main antenna 410 in FIG. 4) and the first ground plane (e.g., first ground plane 430 in FIG. 4) may be implemented on a first printed circuit board (PCB) (e.g., first PCB 430), and the parasitic antenna and the second ground plane may be implemented on a second PCB (e.g., second PCB 440). The first PCB and the second PCB may be substantially parallel to each other on different planes. A primary surface of the second antenna (e.g., first main antenna 420 in FIG. 4) may be on a plane that is angled relative to the planes of the first PCB and the second PCB.

In one approach, at least one processor adjusts 1006 the first, second and/or third impedance tuners to configure the first, second and/or parasitic antennas to achieve a same resonant frequency (e.g., 2.4 GHz in FIG. 9).

In some embodiments, the at least one processor (e.g., processing unit 1116 in FIG. 11) receives data from each of the first, second and parasitic antennas. For example, a processor of the controller 340 (see FIG. 3) may receive data from each of the first, second and parasitic antenna, and the received data may be transmitted from the HWD 320 and/or may include frequency information relating to a resonant frequency. The at least one processor adjusts, according to the received data (e.g., the frequency information), the first, second and third impedance tuners to configure the first, second and/or parasitic antennas to achieve the same resonant frequency.

In some embodiments, the at least one processor adjusts, at a first time, the first, second and third impedance tuners to configure the first, second and parasitic antennas to achieve a first resonant frequency (e.g., a first one of frequency bands 972, 974, 976, 978 in FIG. 9). The at least one processor adjusts at a second time (e.g., that occurs before or after the first time), the first, second and third impedance tuners to configure the first, second and parasitic antennas to achieve a second resonant frequency (e.g., a second one of frequency bands 972, 974, 976, 978 in FIG. 9).

Figure 11:
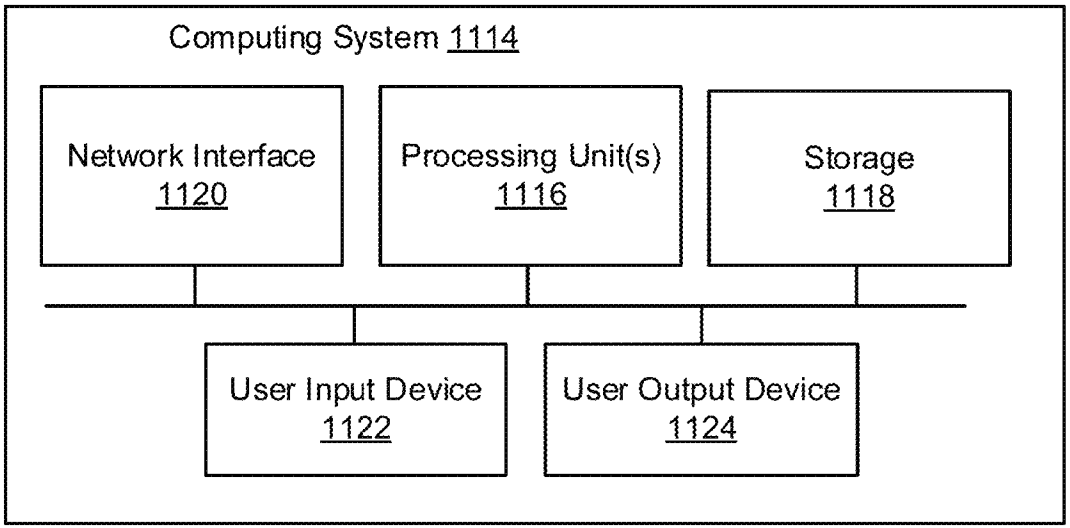
FIG. 11 is a block diagram of a computing environment according to an example implementation of the present disclosure.

Various operations described herein can be implemented on computer systems. FIG. 11 shows a block diagram of a representative computing system 1114 usable to implement the present disclosure. In some embodiments, the computing device 110, the HWD 150 or both of FIG. 1 are implemented by the computing system 1114. Computing system 1114 can be implemented, for example, as a consumer device such as a smartphone, other mobile phone, tablet computer, wearable computing device (e.g., smart watch, eyeglasses, head wearable display), desktop computer, laptop computer, or implemented with distributed computing devices. The computing system 1114 can be implemented to provide VR, AR, MR experience. In some embodiments, the computing system 1114 can include conventional computer components such as processors 1116, storage device 1118, network interface 1120, user input device 1122, and user output device 1124.

Network interface 1120 can provide a connection to a wide area network (e.g., the Internet) to which WAN interface of a remote server system is also connected. Network interface 1120 can include a wired interface (e.g., Ethernet) and/or a wireless interface implementing various RF data communication standards such as Wi-Fi, Bluetooth, or cellular data network standards (e.g., 3G, 4G, 5G, 60 GHz, LTE, etc.).

User input device 1122 can include any device (or devices) via which a user can provide signals to computing system 1114; computing system 1114 can interpret the signals as indicative of particular user requests or information. User input device 1122 can include any or all of a keyboard, touch pad, touch screen, mouse or other pointing device, scroll wheel, click wheel, dial, button, switch, keypad, microphone, sensors (e.g., a motion sensor, an eye tracking sensor, etc.), and so on.

User output device 1124 can include any device via which computing system 1114 can provide information to a user. For example, user output device 1124 can include a display to display images generated by or delivered to computing system 1114. The display can incorporate various image generation technologies, e.g., a liquid crystal display (LCD), light-emitting diode (LED) including organic light-emitting diodes (OLED), projection system, cathode ray tube (CRT), or the like, together with supporting electronics (e.g., digital-to-analog or analog-to-digital converters, signal processors, or the like). A device such as a touchscreen that function as both input and output device can be used. Output devices 1124 can be provided in addition to or instead of a display. Examples include indicator lights, speakers, tactile "display" devices, printers, and so on.

Some implementations include electronic components, such as microprocessors, storage and memory that store computer program instructions in a computer readable storage medium (e.g., non-transitory computer readable medium). Many of the features described in this specification can be implemented as processes that are specified as a set of program instructions encoded on a computer readable storage medium. When these program instructions are executed by one or more processors, they cause the processors to perform various operation indicated in the program instructions. Examples of program instructions or computer code include machine code, such as is produced by a compiler, and files including higher-level code that are executed by a computer, an electronic component, or a microprocessor using an interpreter. Through suitable programming, processor 1116 can provide various functionality for computing system 1114, including any of the functionality described herein as being performed by a server or client, or other functionality associated with message management services.

It will be appreciated that computing system 1114 is illustrative and that variations and modifications are possible. Computer systems used in connection with the present disclosure can have other capabilities not specifically described here. Further, while computing system 1114 is described with reference to particular blocks, it is to be understood that these blocks are defined for convenience of description and are not intended to imply a particular physical arrangement of component parts. For instance, different blocks can be located in the same facility, in the same server rack, or on the same motherboard. Further, the blocks need not correspond to physically distinct components. Blocks can be configured to perform various operations, e.g., by programming a processor or providing appropriate control circuitry, and various blocks might or might not be reconfigurable depending on how the initial configuration is obtained. Implementations of the present disclosure can be realized in a variety of apparatus including electronic devices implemented using any combination of circuitry and software.

Having now described some illustrative implementations, it is apparent that the foregoing is illustrative and not limiting, having been presented by way of example. In particular, although many of the examples presented herein involve specific combinations of method acts or system elements, those acts and those elements can be combined in other ways to accomplish the same objectives. Acts, elements and features discussed in connection with one implementation are not intended to be excluded from a similar role in other implementations or implementations.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device, etc.) may include one or more devices (e.g., RAM, ROM, Flash memory, hard disk storage, etc.) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit and/or the processor) the one or more processes described herein.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

The phraseology and terminology used herein is for the purpose of description and should not be regarded as limiting. The use of "including" "comprising" "having" "containing" "involving" "characterized by" "characterized in that" and variations thereof herein, is meant to encompass the items listed thereafter, equivalents thereof, and additional items, as well as alternate implementations consisting of the items listed thereafter exclusively. In one implementation, the systems and methods described herein consist of one, each combination of more than one, or all of the described elements, acts, or components.

Any references to implementations or elements or acts of the systems and methods herein referred to in the singular can also embrace implementations including a plurality of these elements, and any references in plural to any implementation or element or act herein can also embrace implementations including only a single element. References in the singular or plural form are not intended to limit the presently disclosed systems or methods, their components, acts, or elements to single or plural configurations. References to any act or element being based on any information, act or element can include implementations where the act or element is based at least in part on any information, act, or element.

Any implementation disclosed herein can be combined with any other implementation or embodiment, and references to "an implementation," "some implementations," "one implementation" or the like are not necessarily mutually exclusive and are intended to indicate that a particular feature, structure, or characteristic described in connection with the implementation can be included in at least one implementation or embodiment. Such terms as used herein are not necessarily all referring to the same implementation. Any implementation can be combined with any other implementation, inclusively or exclusively, in any manner consistent with the aspects and implementations disclosed herein.

Where technical features in the drawings, detailed description or any claim are followed by reference signs, the reference signs have been included to increase the intelligibility of the drawings, detailed description, and claims. Accordingly, neither the reference signs nor their absence have any limiting effect on the scope of any claim elements.

Systems and methods described herein may be embodied in other specific forms without departing from the characteristics thereof. References to "approximately," "about" "substantially" or other terms of degree include variations of +/−10% from the given measurement, unit, or range unless explicitly indicated otherwise. Coupled elements can be electrically, mechanically, or physically coupled with one another directly or with intervening elements. Scope of the systems and methods described herein is thus indicated by the appended claims, rather than the foregoing description, and changes that come within the meaning and range of equivalency of the claims are embraced therein.

The term "coupled" and variations thereof includes the joining of two members directly or indirectly to one another. Such joining may be stationary (e.g., permanent or fixed) or moveable (e.g., removable or releasable). Such joining may be achieved with the two members coupled directly with or to each other, with the two members coupled with each other using a separate intervening member and any additional intermediate members coupled with one another, or with the two members coupled with each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References to "or" can be construed as inclusive so that any terms described using "or" can indicate any of a single, more than one, and all of the described terms. A reference to "at least one of 'A' and 'B'" can include only 'A', only 'B', as well as both 'A' and 'B'. Such references used in conjunction with "comprising" or other open terminology can include additional items.

Modifications of described elements and acts such as variations in sizes, dimensions, structures, shapes and proportions of the various elements, values of parameters, mounting arrangements, use of materials, colors, orientations can occur without materially departing from the teachings and advantages of the subject matter disclosed herein. For example, elements shown as integrally formed can be constructed of multiple parts or elements, the position of elements can be reversed or otherwise varied, and the nature or number of discrete elements or positions can be altered or varied. Other substitutions, modifications, changes and omissions can also be made in the design, operating conditions and arrangement of the disclosed elements and operations without departing from the scope of the present disclosure.

References herein to the positions of elements (e.g., "top," "bottom," "above," "below") are merely used to describe the orientation of various elements in the FIGURES. The orientation of various elements may differ according to other exemplary embodiments, and that such variations are intended to be encompassed by the present disclosure.

What is claimed is:

1. A wireless device comprising:

a first antenna with a feed connected to a first impedance tuner that is connected to a first ground plane, the first antenna configured to perform wireless communication;

a second antenna with a feed connected to a second impedance tuner, the second antenna configured to perform wireless communication; and a parasitic antenna disposed between the first and second antennas, with a feed connected to a third impedance tuner that is connected to a second ground plane, wherein the first, second and third impedance tuners are adjusted to configure the first, second and parasitic antennas to achieve a same resonant frequency.

2. The wireless device of claim 1, wherein:

the first antenna and the first ground plane are implemented on a first printed circuit board (PCB), and the parasitic antenna and the second ground plane are implemented on a second printed circuit board (PCB).

3. The wireless device of claim 2, wherein the first PCB and the second PCB are substantially parallel to each other on different planes.

4. The wireless device of claim 3, wherein a primary surface of the second antenna is on a plane that is angled relative to the planes of the first PCB and the second PCB.

5. The wireless device of claim 1, comprising:

a controller configured to adjust the first, second and third impedance tuners to configure the first, second and parasitic antennas to achieve the same resonant frequency.

6. The wireless device of claim 1, wherein the wireless device comprises a handheld controller device.

7. The wireless device of claim 1, wherein the first, second and third impedance tuners are adjusted at a first time to configure the first, second and parasitic antennas to achieve a first resonant frequency, and adjusted at a second time to configure the first, second and parasitic antennas to achieve a second resonant frequency.

8. The wireless device of claim 1, wherein:

the first antenna and the second antenna are configured to perform wireless communication with a same head wearable device.

9. The wireless device of claim 8, wherein:

the first antenna and the second antenna are configured to perform wireless communication at a same operating frequency with the same head wearable device.

10. The wireless device of claim 9, wherein:

the first antenna is configured to perform wireless communication with the head wearable device using a first wireless communication protocol, and the first antenna is configured to perform wireless communication with the head wearable device using a second wireless communication protocol different from the first wireless communication protocol.

11. A method, comprising:

performing, by a first antenna with a feed connected to a first impedance tuner that is connected to a first ground plane, wireless communication;

performing, by a second antenna with a feed connected to a second impedance tuner, wireless communication, wherein a parasitic antenna is disposed between the first and second antennas, and has a feed connected to a third impedance tuner that is connected to a second ground plane; and adjusting, by at least one processor, the first, second and third impedance tuners to configure the first, second and parasitic antennas to achieve a same resonant frequency.

12. The method of claim 11, wherein the first antenna and the first ground plane are implemented on a first printed circuit board (PCB), and the parasitic antenna and the second ground plane are implemented on a second printed circuit board (PCB).

13. The method of claim 12, wherein the first PCB and the second PCB are substantially parallel to each other on different planes.

14. The method of claim 13, wherein a primary surface of the second antenna is on a plane that is angled relative to the planes of the first PCB and the second PCB.

15. The method of claim 11, comprising:

receiving, by the at least one processor, data from each of the first, second and parasitic antennas; and adjusting, by the at least one processor according to the received data, the first, second and third impedance tuners to configure the first, second and parasitic antennas to achieve the same resonant frequency.

16. The method of claim 11, wherein the first, second and parasitic antennas are included in a wireless device which comprises a handheld controller device.

17. The method of claim 11, comprising:

adjusting, by the at least one processor at a first time, the first, second and third impedance tuners to configure the first, second and parasitic antennas to achieve a first resonant frequency; and adjusting, by the at least one processor at a second time, the first, second and third impedance tuners to configure the first, second and parasitic antennas to achieve a second resonant frequency.

18. The method of claim 11, comprising:

performing, by the first antenna, wireless communication with a head wearable device; and performing, by the second antenna, wireless communication with the head wearable device.

19. The method of claim 18, comprising:

performing, by the first antenna, wireless communication with the head wearable device at a defined operating frequency; and performing, by the second antenna, wireless communication with the head wearable device at the defined operating frequency.

20. The method of claim 19, wherein:

performing, by the first antenna, wireless communication with the head wearable device using a first wireless communication protocol; and performing, by the second antenna, wireless communication with the head wearable device using a second wireless communication protocol different from the first wireless communication protocol.

* * * * *